US006937233B2

(12) United States Patent
Sakuma et al.

(10) Patent No.: US 6,937,233 B2
(45) Date of Patent: Aug. 30, 2005

(54) LIQUID CRYSTAL DISPLAY

(75) Inventors: Katsuyuki Sakuma, Yamato (JP); Yoshitami Sakaguchi, Hadano (JP)

(73) Assignee: International Business Machines Corporation, Armonk, NY (US)

( * ) Notice: Subject to any disclaimer, the term of this patent is extended or adjusted under 35 U.S.C. 154(b) by 379 days.

(21) Appl. No.: 10/064,260

(22) Filed: Jun. 26, 2002

(65) Prior Publication Data

US 2003/0001808 A1 Jan. 2, 2003

(30) Foreign Application Priority Data

Jun. 29, 2001 (JP) ..... 2001-200190

(51) Int. Cl.[7] ..... G09G 5/00; G09G 3/36

(52) U.S. Cl. ..... 345/211; 345/87; 345/98; 345/100

(58) Field of Search ..... 345/211, 212, 345/87, 98–100, 90, 93, 96

(56) References Cited

U.S. PATENT DOCUMENTS 5,801,674 A * 9/1998 Shimizu ..... 345/103
6,211,849 B1 * 4/2001 Sasaki et al. ..... 345/55
6,628,259 B2 * 9/2003 Hashimoto ..... 345/98

* cited by examiner

*Primary Examiner*—Regina Liang
*Assistant Examiner*—Duc Q Dinh
(74) *Attorney, Agent, or Firm*—McGinn & Gibb, PLLC; Eustus D. Nelson, Esq.

(57) ABSTRACT

JP920010143US1 A liquid crystal display includes liquid crystal cells for forming an image display area on a substrate, a source driver for applying a voltage to the liquid crystal cells using a plurality of source driver ICs to which power is supplied in a single stroke of the brush fashion and an LCD controller for processing signals received from a host's side via video I/F and supplying the processed signals to the source driver Ics. The source driver delays the start timing for writing the liquid crystal cells among the plurality of source driver ICs respectively to avoid the concentration of current consumption.

14 Claims, 21 Drawing Sheets

(a)

(b)

| Source driver IC | Contents of setting registers |
|---|---|
| #1 | 4 |
| #2 | 3 |
| #3 | 2 |
| #4 | 1 |
| #5 | 0 |

LIQUID CRYSTAL DISPLAY

BACKGROUND OF INVENTION

1. Field of the Invention

The present invention relates to a liquid crystal display for displaying images on the basis of input video signals, and more particularly to a liquid crystal display in which start timing for writing a liquid crystal is improved.

2. Background Art

In general, when an image is displayed on a liquid crystal display (LCD), image signals are output from a graphics controller in a system unit or system part of a PC or the like (i.e., host's side) via a video interface. An LCD controller LSI, which receives these image signals, supplies signals to each IC in a source driver (i.e., X driver, LCD source driver) and gate driver (i.e., Y driver), and then a voltage is applied to each source electrode and each gate electrode in a TFT array arranged in a matrix fashion, thereby leading to displaying images. As a mounting and wiring scheme employed in this LCD source driver, technologies called chip-on-glass (COG) and wiring-on-array (WOA) have recently become the focus of attention. Also, a technology is being developed where a driver LSI is arranged in a TCP (tape carrier package) and connected to the TFT array substrate (glass substrate) via the TCP. It is expected that manufactures' costs will be greatly reduced by applying these technologies to attach ICs directly on the glass substrate or via the TCP as well as to eliminate wiring on a printed circuit board.

FIGS. 21(*a*) and (*b*) shows an example of wiring for source drivers and measured current results on the power supply line when writing the liquid crystal simultaneously. In the wiring for source drivers shown in FIG. 21(*a*), video signals, control signals and power supply lines are connected via bus to a plurality of LCD source drivers 201. The start timing for writing the liquid crystal (TFT array) is controlled by the LCD controller (not shown) activating the output start signal 202, wherein all of the mounted LCD source drivers 201 start writing of the liquid crystal simultaneously. At this time, there occurs a spike current on the order of several hundreds milliamperes on the power supply line as shown in FIG. 21(*b*).

Conventionally, the wiring between the LCD source drivers 201 has been implemented as copper wiring on the PCB (printed circuit board) or FPC (flexible printed circuit). On the other hand, for the above-mentioned COG and WOA technologies, LCD source drivers 201 are mounted directly on the TFT array substrate and the wiring between LCD source drivers 201 is implemented by means of aluminum or the like on the substrate by employing the TFT array process. In this case, the aluminum wiring on the TFT array substrate is limited to about 2500Å in thickness in order to improve the manufacturing yield and to reduce process time occupied. This does not allow an adequate current capacity so that the problem has occurred that the power supply line blows when several hundreds milliamperes of spike current flows as shown in FIG. 21(*b*). Namely, the power supply lines on the PCBs or FPCs according to the prior art can assure the adequate current capacities so that no blowing of the power supply lines has occurred, while when employing the COG or WOA technologies, blowing of the power supply lines formed on the glass might occur.

Moreover, for the LCD panels where the power supply lines are formed on the PCBs or FPCs, there has been no problem about voltage drop due to the wiring. However, when employing COG or WOA technologies, the voltage drop over the power supply lines increases because it is difficult to implement power supply lines that have adequate current capacities, as described above. When this voltage drop increases, the supply voltage for LCD source drivers 201 decreases, which causes the delay of writing of the liquid crystal. Consequently, the writing voltage for each of the LCD source drivers 201 differs depending on the positions of them in terms of distance from the portal of the power supply (e.g., either the upstream side close to the power source or the downstream side far away from the power source), which results in degrading the uniformity of image qualities.

SUMMARY OF INVENTION

In view of the technical problems described above, a feature of the present invention is to solve the problem of blowing of power supply lines even when employing the wiring which cannot assure an adequate current capacity for LCD panels. Another feature of the invention is to alleviate the concentration of current consumption for LCD source drivers.

According to the present invention, the power supply for source driver ICs mounted on the TFT array substrate for the liquid crystal cell is supplied in a single stroke of the brush fashion (i.e., continuously) by means of bus connections or cascade connections. For this configuration, writing of the liquid crystal is sequentially performed with a predetermined time difference starting from a source driver located most downstream with respect to the power supply line towards the one located most upstream. Namely, a liquid crystal display according to the present invention comprises: liquid crystal cells for forming an image display area on a substrate; a driver for applying a voltage to the liquid crystal cells using a plurality of driver ICs; and an LCD controller for processing signals received from a host's side and supplying the processed signals to the driver ICs, wherein the driver delays the start timing for writing the liquid crystal cells among the plurality of driver ICs respectively to avoid the concentration of current consumption.

In another aspect of the present invention, a liquid crystal display according to the present invention comprises a plurality of driver ICs which are supplied power by means of bus connections or cascade connections on a substrate and each including a timer that operates according to time information from an LCD controller, wherein each of the plurality of driver ICs is set start timing for writing the liquid crystal cells respectively and measures the write start timing by using the timer based on, for example, the time information from the LCD controller, and wherein the driver IC that meets the conditions starts writing of the liquid crystal cells sequentially. The write start timing respectively set is determined dependent on a wiring capacity of a power supply line for each of the driver ICs. This allows to cope with various kinds of LCD panels.

In another aspect of the present invention, a liquid crystal display according to the present invention comprises a plurality of driver ICs that are connected continuously from a power source to be supplied power and perform writing of liquid crystal cells sequentially, wherein the driver ICs monitor a voltage drop of a power supply line and start writing of the liquid crystal cells such that the voltage drop does not fall below a predetermined reference voltage drop.

The predetermined reference voltage drop is set close to a minimum voltage of a potential difference signal that is measured when the driver IC itself performs writing of the liquid crystal cells (for example, the predetermined value may be the one that ensures a given downward margin below the minimum voltage). With this configuration, the driver ICs can perform writing of the liquid crystal cells sequentially starting from the most downstream driver IC towards the most upstream one with delaying the write timing when the power is supplied in a single stroke of the brush fashion.

In a further aspect of the present invention, there is provided a liquid crystal display driver for performing writing of liquid crystal cells that form an image display area by applying a voltage thereto, the driver comprising: a setting register for storing information about write delay time for delaying write timing of the liquid crystal cells; a counter for counting the write delay time stored in the setting register; a sequencer for activating a delayed output start signal based on an output from the counter; and a control circuit for controlling the writing of the liquid crystal cells based on the output start signal activated by the sequencer.

In another aspect of the present invention, a liquid crystal display driver of the invention comprises: means for measuring a potential difference on a power supply line; means for setting a reference voltage drop; and means for controlling start timing for writing liquid crystal cells based on the reference voltage drop and the measured potential difference.

In a further aspect of the present invention, there is provided an LCD controller for processing signals received from a host's side and supplying the processed signals to a plurality of driver ICs in a timed manner. The LCD controller comprises means for outputting timing setting data that represents delay time for the driver ICs to start outputting to liquid crystal cells; means for outputting a control strobe signal to count the delay time stored in the driver ICs according to the timing setting data; and means for serial transferring to the driver ICs as control data signals an output start signal for starting a liquid crystal output and a polarity select signal indicating a polarity of the liquid crystal output. The timing setting data output means is capable of outputting the timing setting data during a period when video data is not being transferred, such as a blanking period.

In a further aspect of the present invention, there is provided a method for driving a plurality of driver ICs that are provided on a substrate on which liquid crystal cells are formed, wherein the driver ICs apply a writing voltage to the liquid crystal cells and are supplied power in a single stroke of the brush fashion, the method comprising the steps of: setting write start timing for applying the writing voltage to the liquid crystal cells for each of the plurality of driver ICs; counting according to predetermined time information sent from, for example, an LCD controller; and applying the writing voltage to the liquid crystal cells sequentially from the driver IC that has reached the write start timing.

In a further aspect of the present invention, there is provided a method for driving a plurality of driver ICs, comprising: measuring a voltage drop on a power supply line of the individual driver ICs of the plurality of driver ICs; comparing the measured voltage drop to a predetermined reference voltage drop; and turning off the writing of the liquid crystal cells for the individual driver ICs when the measured voltage drop is below the predetermined reference voltage drop. This allows driver ICs located upstream with respect to the power supply line to start writing of the liquid crystal cells after downstream driver ICs start writing.

Various other objects, features, and attendant advantages of the present invention will become more fully appreciated as the same becomes better understood when considered in conjunction with the accompanying drawings, in which like reference characters designate the same or similar parts throughout the several views.

BRIEF DESCRIPTION OF DRAWINGS

FIG. 1 depicts a configuration of an embodiment of an image display unit the present invention is applied to.

DETAILED DESCRIPTION

From the foregoing description, one skilled in the art can easily ascertain the essential characteristics of this invention and, without departing from the spirit and scope thereof, can make various changes and modifications of the invention to adapt it to various usages and conditions.

Figure 1:
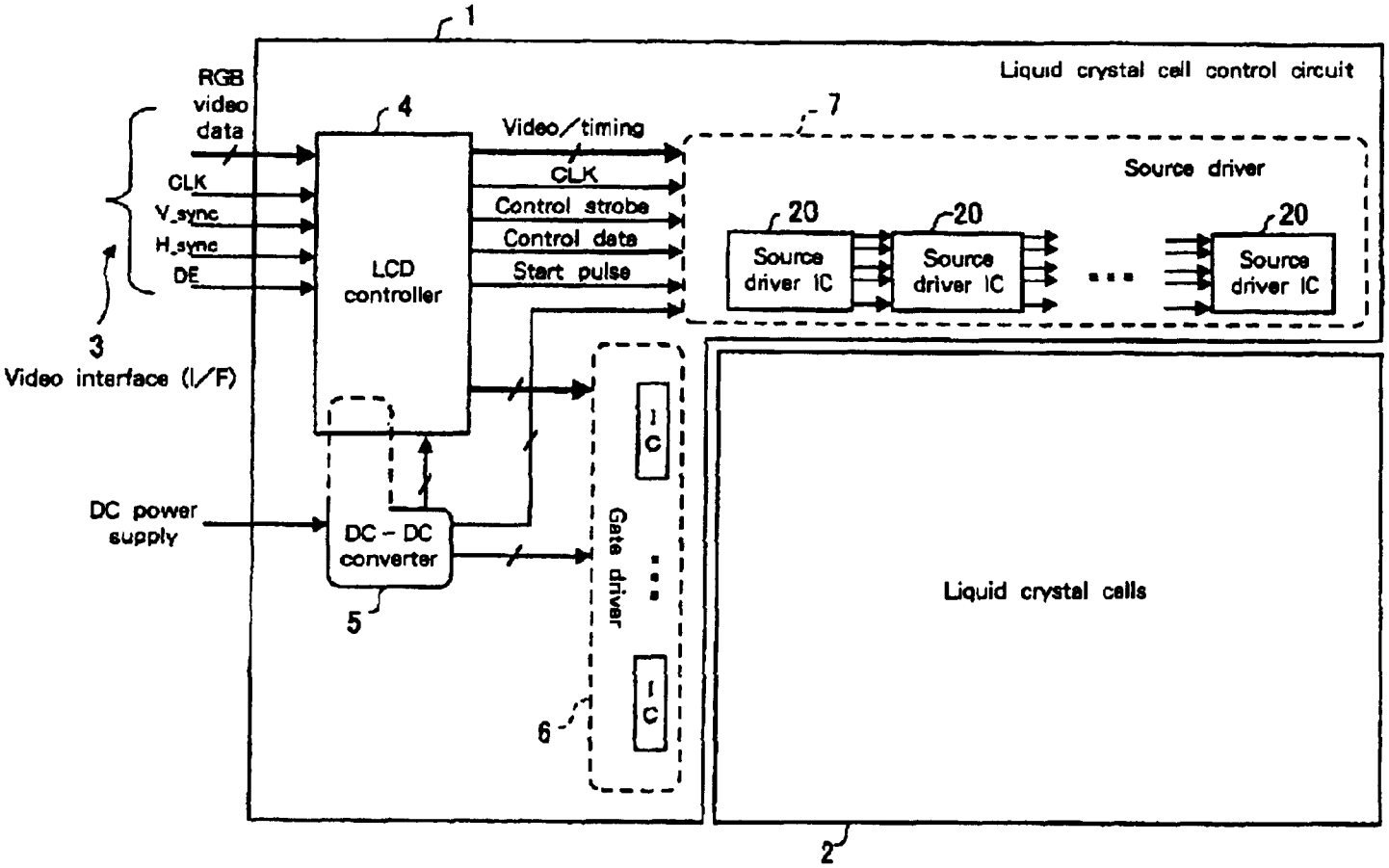

FIG. 1 is a schematic diagram illustrating an embodiment of an image display unit the present invention is applied to.

In the image display unit shown in FIG. 1, a liquid crystal display module (LCD) is comprised of a liquid crystal cell control circuit 1 and liquid crystal cells 2 in a thin film transistor (TFT) structure. This liquid crystal display module may be configured as a display unit separate from a host system such as a personal computer (PC) or as a display of a notebook PC. In liquid crystal cell control circuit 1, RGB video data (i.e., video signals) and control signals, such as a dot clock (CLK), a vertical sync signal ($V_{13}$ sync), a horizontal sync signal ($H_{13}$ sync), a data enable signal (DE), etc., are input to an LCD controller 4 via a video interface (I/F) 3 from a graphics controller LSI (not shown) in the system. Also, DC power supply is also supplied through the video I/F 3.

DC-DC converter 5 generates a variety of DC power supply voltages necessary for liquid crystal cell control circuit 1 from DC power supply being supplied, and supplies them to a gate driver 6, a source driver 7 and a fluorescent tube for backlight, etc. LCD controller 4 processes signals received from video I/F 3 and supplies processed signals to each of ICs in gate driver 6 and source driver 7 in a timed manner. Source driver 7 is responsible to supply a voltage to each of the source electrodes of TFTs arranged in a horizontal direction (X direction) in a TFT array, which is arranged in a matrix fashion on liquid crystal cells 2. Gate driver 6 is responsible to supply a voltage to each of the gate electrodes arranged in a vertical direction (Y direction) in a TFT array. In the embodiment of the invention, there are provided a control strobe signal and control data signal in serial as outputs of LCD controller 4 instead of conventional control signals and setting signals.

Both gate driver 6 and source driver 7 are comprised of multiple ICs. In the present embodiment, source driver 7 includes multiple source driver ICs 20 made of LSI chips. For convenience of explanation, liquid crystal cell control circuit 1 and liquid crystal cells 2 are shown to be divided in FIG. 1, however, according to the embodiment of the present invention, multiple source driver ICs 20 are formed in the COG structure on a glass substrate where liquid crystal cells 2 are made, and furthermore each wiring is also made on the glass substrate in the WOA structure.

In this manner, for LCDs having a frame with narrow rims around a display area, miniaturization and cost reduction of LCD panel is achieved by mounting source driver 7 directly on the TFT glass substrate of the LCD panel and implementing wiring between source drivers ICs 20 using aluminum wiring on the glass substrate. In this case, power supply for source driver ICs 20 mounted on the TFT glass substrate is supplied in a single stroke of the brush fashion (i.e., continuously) by means of bus connections or cascade connections. In the embodiment of the invention, writing of the liquid crystal is started sequentially with a predetermined time difference from the source driver IC 20 located most downstream towards the one located most upstream with respect to the power supply line.

When controlling timing for writing the liquid crystal individually by using the conventional LCD source drivers, there is needed as many individual wiring lines as LCD source drivers being mounted. Then, the LCD controller must control LCD source drivers individually via these wiring lines. For the LCD panels using the COG or WOA scheme, this inconveniently requires the increase of the wiring space. On the contrary, the present invention enables controlling each of the source driver ICs 20 and initial settings using two signal lines including a control strobe signal and a control data signal, thus the individual source driver ICs 20 are controlled of their write timing of the liquid crystal using this interface. Namely, a polarity select, output start, and setting pins are replaced with the control strobe and control data pins. Such wiring can be implemented using cascade connections going through the wiring inside the chip as well as bus connections.

Figure 2:
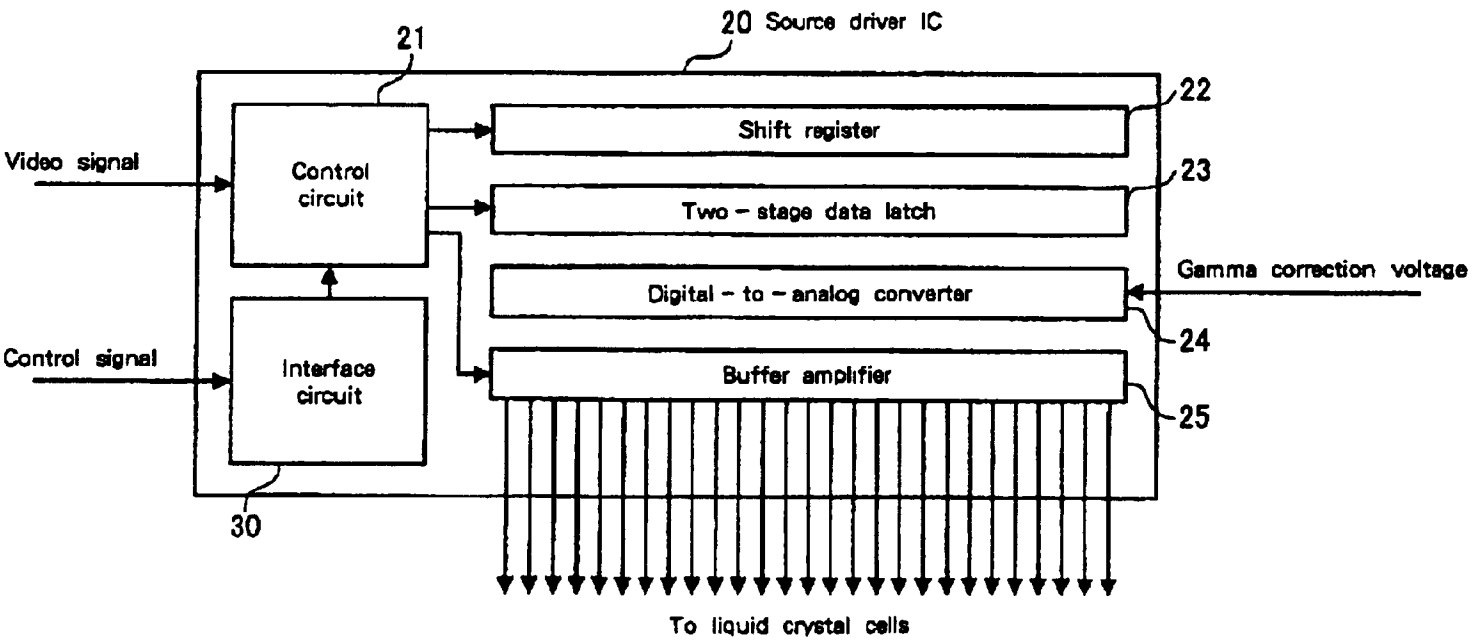
FIG. 2 depicts a configuration of a source driver IC according to the present invention.

FIG. 2 depicts a configuration of source driver IC 20 according to the present invention. Source driver IC 20 comprises an interface circuit 30 indicative of the features of the invention, and a control circuit 21 that receives video signals and outputs from interface circuit 30 and controls outputs to liquid crystal cells 2 constituting the TFT array. Furthermore, there are provided a shift register 22 operating according to the output from control circuit 21, a two-stage data latch 23, and a buffer amplifier 25 as well as a digital-to-analog (D/A) converter 24 that receives a gamma correction voltage and D/A converts the value of data latch 23 to output to buffer amplifier 25.

Figure 3:
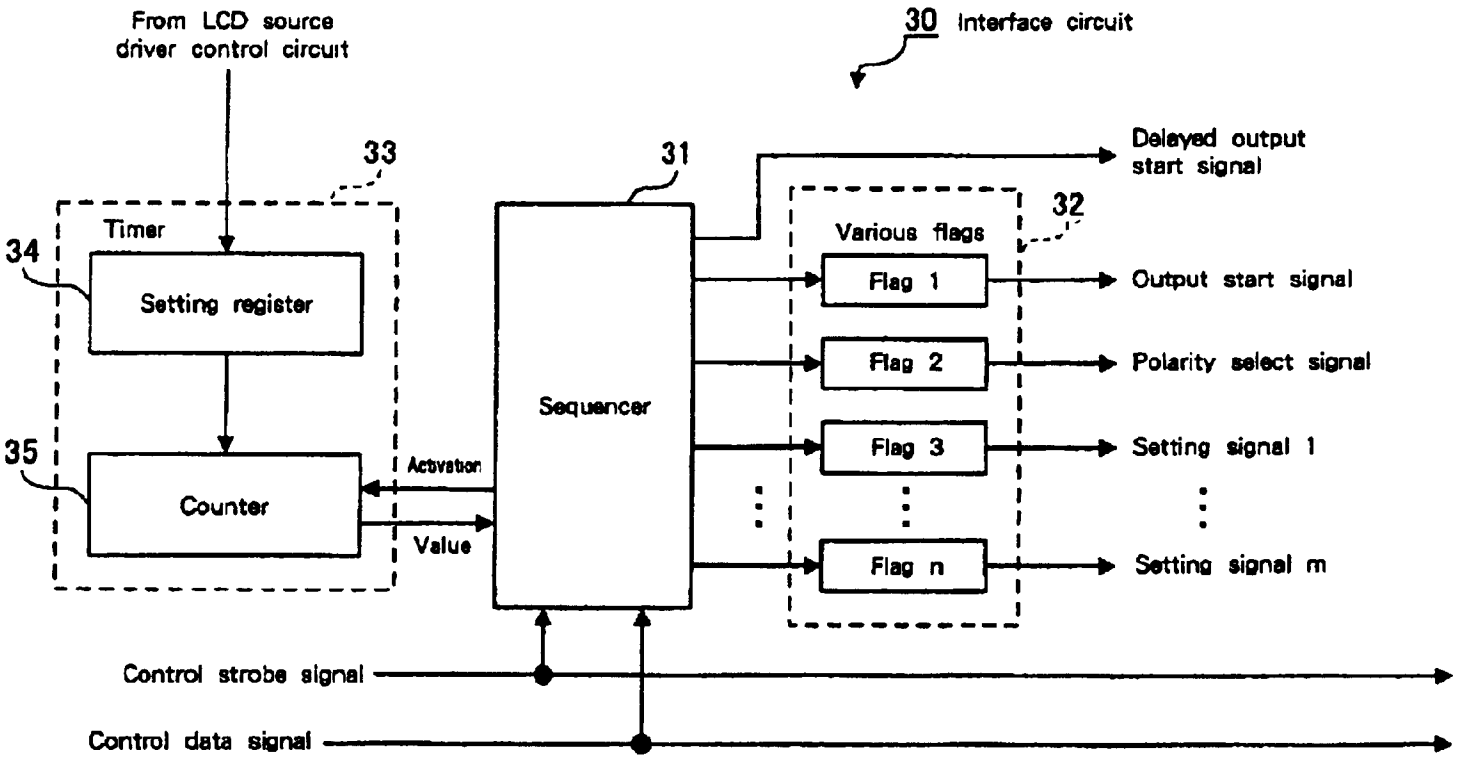
FIG. 3 depicts a configuration of an interface circuit shown in FIG. 2.

FIG. 3 depicts a configuration of interface circuit 30 shown in FIG. 2. In the embodiment of the invention, a control strobe signal and a control data signal are input to interface circuit 30 as control signals. The interface circuit 30 comprises a sequencer 31 for receiving the control data according to the control strobe signal, various kinds of flags 32 for storing control data received, and a timer 33 for setting delay time or the like. Timer 33 is comprised of a setting register 34 for setting delay time for writing the liquid crystal and a counter 35 for counting the delay time. The control signals are generated by serializing the conventional control signals (e.g., polarity select signal and output start signal) and setting signals, and are read by sequencer 31 at every rising edge of the control strobe signal. The control signals read are stored in the various kinds of flags 32 and these values are used in control circuit 21 shown in FIG. 2.

Figure 4:
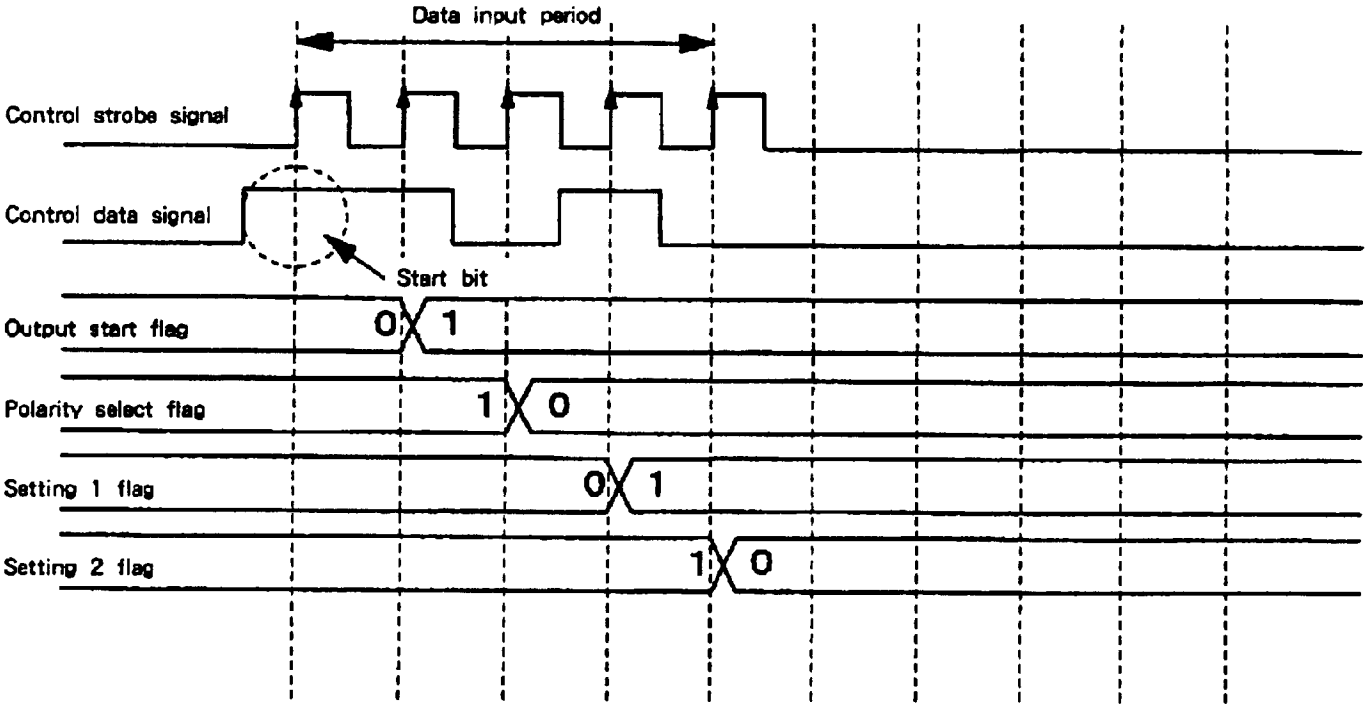
FIG. 4 depicts input waveforms of the control strobe signal and control data signal.

FIG. 4 depicts input waveforms of the control strobe and control data signals. In this example, there are shown two control signals, i.e., an output start flag and polarity select flag and two internal setting signals, i.e., a setting 1 flag and setting 2 flag. The control data signal starts with a start bit representing a start of data, thereafter the output start signal, polarity select signal, setting 1 and setting 2 continue in order. In this example, since only five bits information including a start bit is transmitted, five pulses of the control strobe signal are to be valid. LCD controller 4 transfers control data according to the sequence shown in FIG. 4 when video data has been completely transferred, or when starting the writing of the liquid crystal or when modifying the internal settings. Moreover, it is also possible to reset the sequence to wait for the start bit again by generating the strobe signal while the control data is zero.

Timing control for writing of the liquid crystal is performed using the interface scheme described above and setting register 34 and counter 35 shown in FIG. 3. LCD controller 4 writes write delay time into setting register 34 by using the wiring for transfer of video data during a blanking period, for example, when video data is not transferred. Though individual values need to be set to each of the source driver ICs 20, it is possible by using the same scheme as in the video data transfer. The value of setting register 34 (i.e., write delay time) is to be the number of control strobes to be counted by source driver IC 20 after LCD controller 4 directed the output start.

Figure 5:
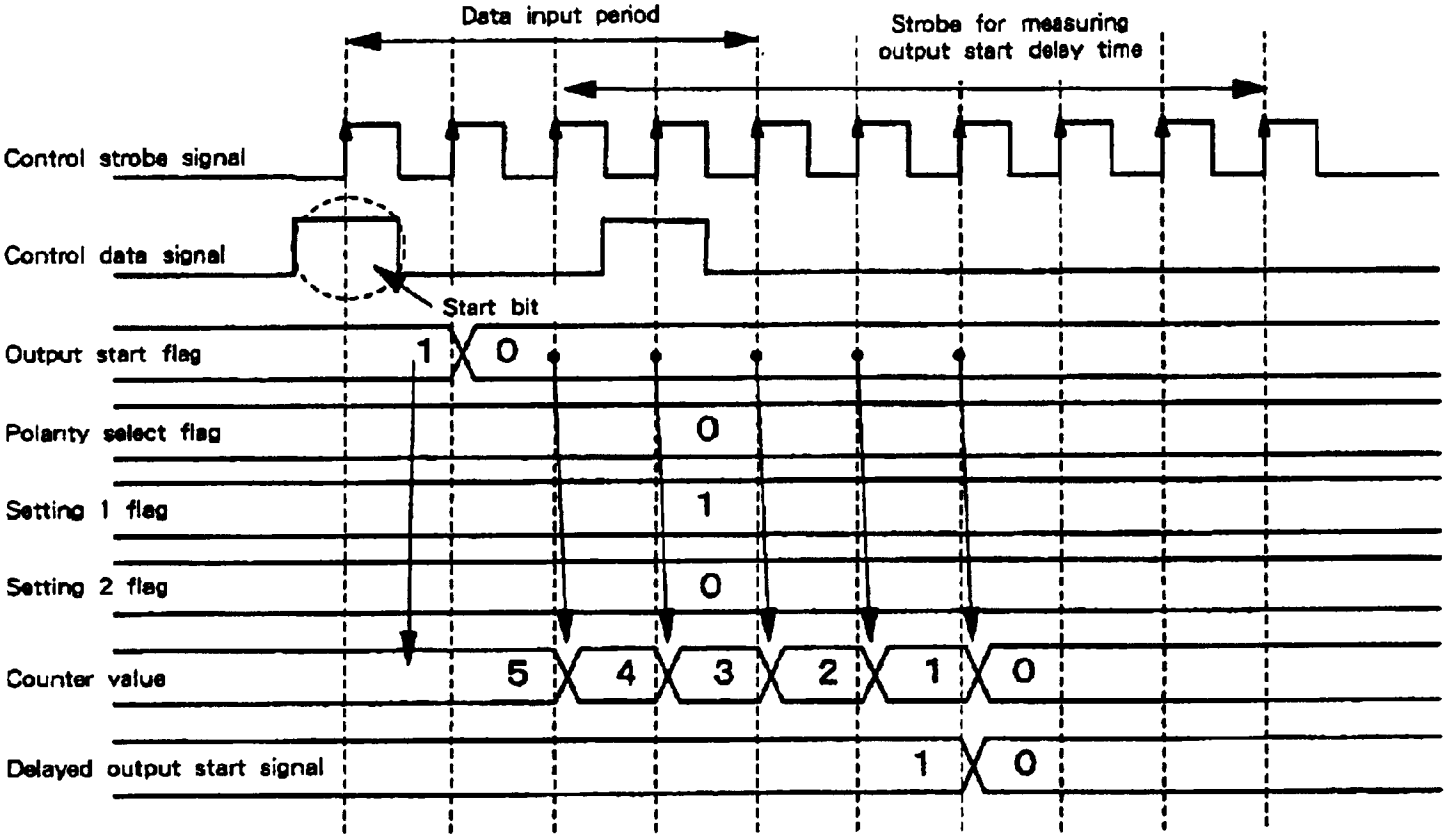
FIG. 5 depicts a timing chart showing a delay of write start timing.

FIG. 5 depicts a timing chart showing a delay of write start timing. A predetermined value for write delay time set by LCD controller 4 is loaded into counter 35 as an initial value while the output start flag is 1. When the output start flag becomes zero, sequencer 31 of FIG. 3 activates counter 35 and counter 35 starts counting down. The count down ends when counter 35 has become zero, just then sequencer 31 activates the delayed output start signal. Then, control circuit 21 in source driver IC 20 starts writing of the liquid crystal cells 2 according to the delayed output start signal.

Thus if different values are set to setting registers 34 for each of the source driver ICs 20, the start timing for writing for the individual source driver ICs 20 is easily controlled by LCD controller 4. The delay time is usually to be the control strobe period multiplied by the value of setting register 34. However, the control strobe period need not be constant, so that LCD controller 4 may operate an interval of control strobes to implement nonlinear delay time differences.

It will now be described about the interface between LCD controller 4 and source driver ICs 20.

Figure 6:
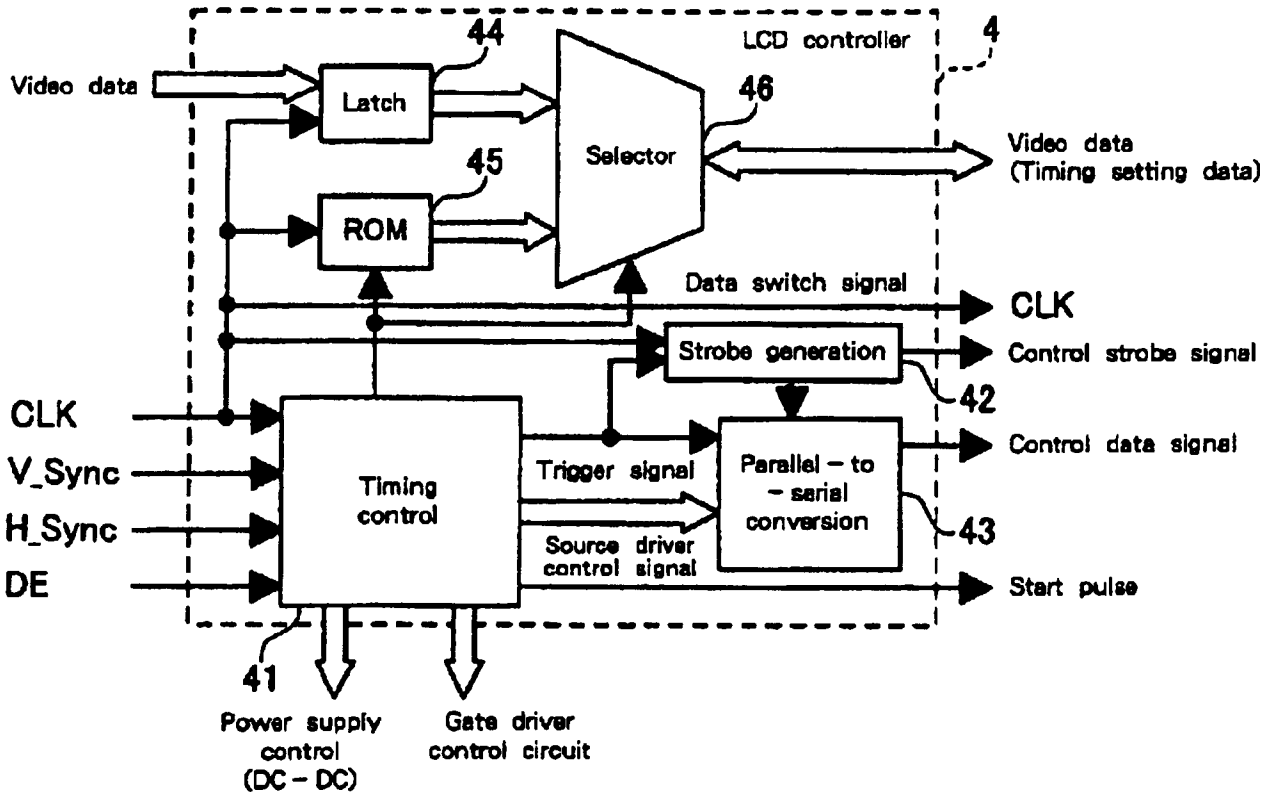
FIG. 6 is a block diagram showing a configuration of LCD controller.

FIG. 6 is a block diagram showing a configuration of LCD controller 4. LCD controller 4 of the invention comprises a timing control circuit 41 for receiving control signals and controlling gate driver 6 and source driver 7, a strobe generation circuit 42 for receiving a trigger signal from timing control circuit 41 and generating a strobe signal, and a parallel-to-serial conversion circuit 43 for converting source driver control signals received from timing control circuit 41 from a parallel format to serial format. Furthermore, there are provided a latch circuit 44 for latching video data being input from the host's side, ROM 45 for storing timing setting data prepared in advance, and a selector 46 for switching between video data and timing setting data.

The selector 46 performs switching between video data and timing setting data based on a data switch signal sent from timing control circuit 41 and outputs either signal to source driver 7. The control strobe signal and control data signal are necessary to control source driver 7 with serialized signals and are generated by a strobe generation circuit 42 and parallel-to-serial conversion circuit 43, respectively.

Figure 7:
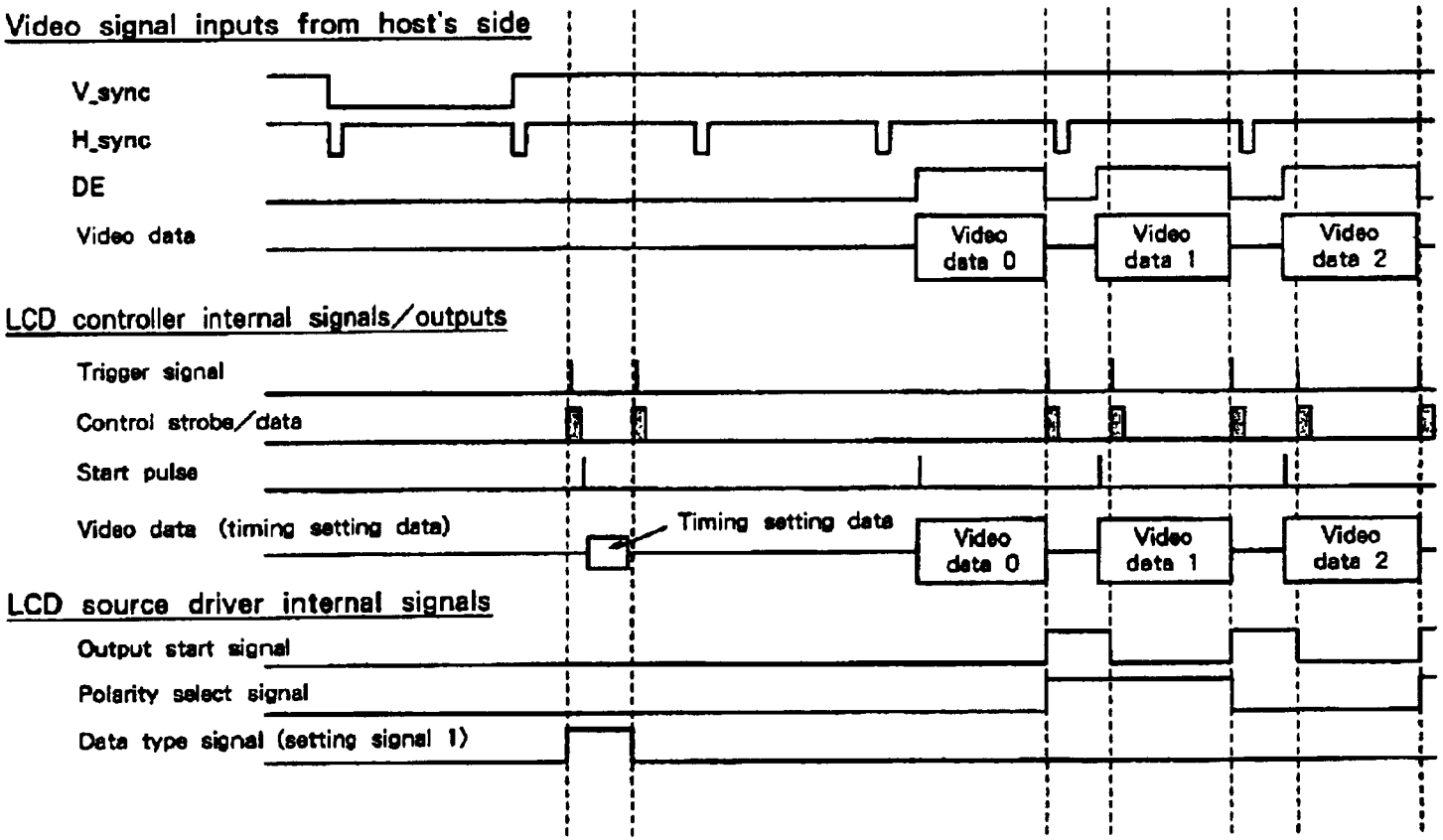
FIG. 7 depicts signal waveforms between LCD controller and source drivers.

FIG. 7 depicts signal waveforms between LCD controller 4 and source driver 7. The data types output from LCD controller 4 include video data and timing setting data. LCD controller 4 transfers video data to source driver 7 when receiving the video data from the host's side. At the same time, it generates and outputs a start pulse indicative of a start of video data. Furthermore, it transfers the following signals in serial using two signal lines of control strobe and control data, that is, a signal for causing source driver 7 to start outputting to the liquid crystal (i.e., output start signal), a signal indicative of the polarity of the liquid crystal output (i.e., polarity select signal), and a data type signal indicating whether the transfer data is video data or timing setting data. Source driver IC 20 recognizes the start of video data with the start pulse and then sequentially takes necessary video data. It also receives the above-mentioned control signals via the two signal lines of control strobe and control data. The trigger signal shown in FIG. 7 is an internal signal generated by timing control circuit 41 in LCD controller 4, which indicates the timing of outputting the control strobe and control data signals. The timing setting data is what indicates delay time for each of the source drivers to start outputting to the liquid crystal cells 2 and is stored in setting register 34 in each of the source driver ICs 20. As shown in FIG. 7, the timing setting data is output from LCD controller 4 according to the same procedure as for the video data, except that the data type is set to 1 (indicating timing setting data) by the control strobe and control data signals which are output immediately before the timing setting data is output and then the data type is reset to zero (indicating video data) by the control strobe and control data signals which are output immediately after the timing setting data has been ended.

Figure 8:
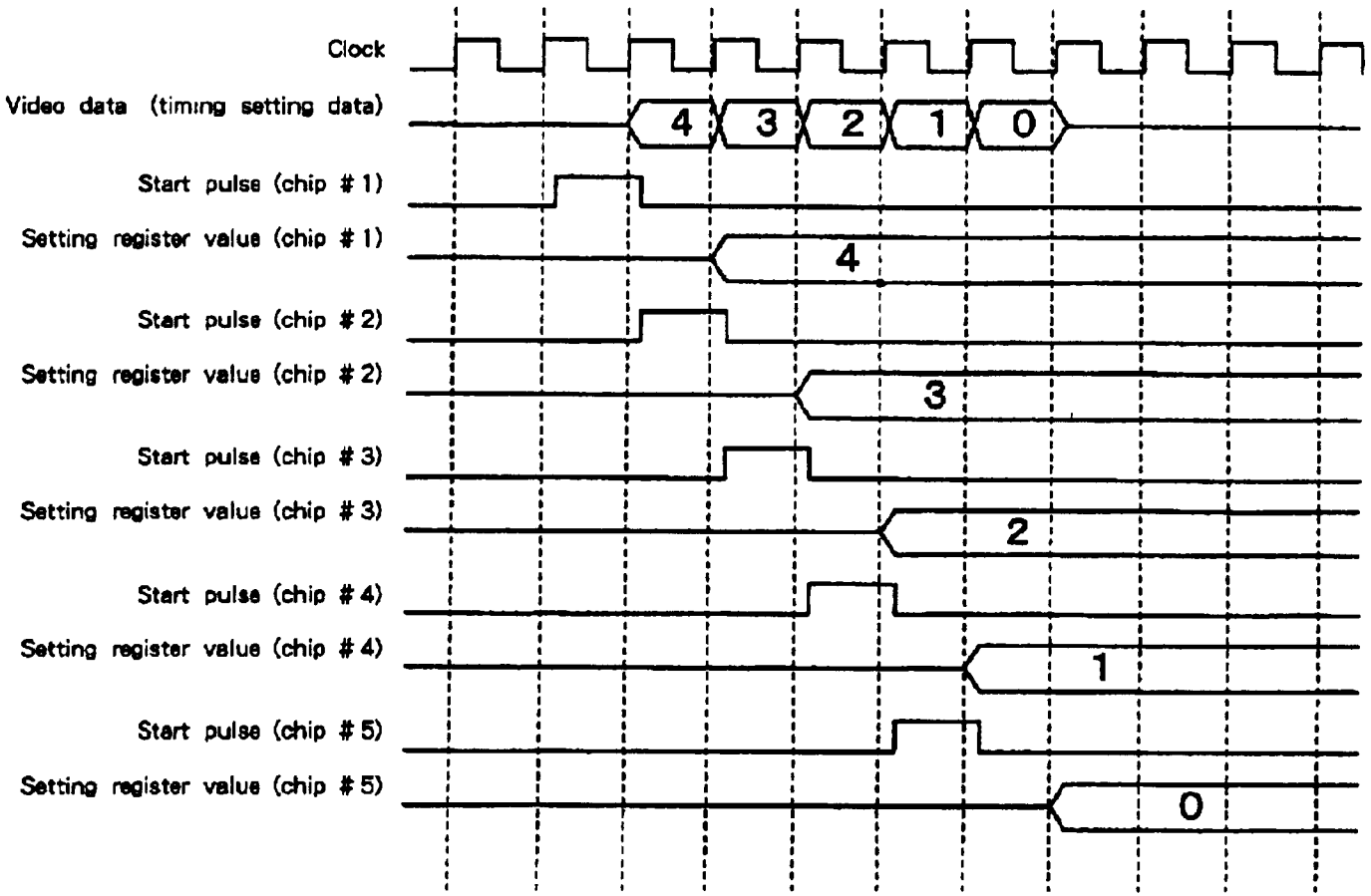
FIG. 8 is a timing chart showing how timing setting data is transferred to a setting register in each of source driver ICs.

FIG. 8 is a timing chart showing how timing setting data is transferred to setting register 34 in each of the source driver ICs 20. This diagram shows when five source driver ICs 20 are connected in a cascade fashion. LCD controller 4 outputs the timing setting data on the video data lines in synchronization with the dot clock. At the same time, it outputs a start pulse indicative of the start of data to a first one of source driver ICs 20 (chip #1) connected in the cascade fashion. The chip #1 receives and stores the timing setting data equal to 4 in setting register 34 at the next clock after receiving the start pulse. Furthermore, the chip #1 latches the start pulse at the rising edge of the clock and outputs to the succeeding source driver IC 20 (chip #2) as the start pulse. Source driver ICs 20 following the chip #2 also receive the timing setting data in the same procedure and output the start pulse to their succeeding source driver IC 20. In this manner, LCD controller 4 transfers the timing setting data to each of the source driver ICs 20 according to the procedure described above during the blanking period (e.g., vertical blanking period).

Figure 9:
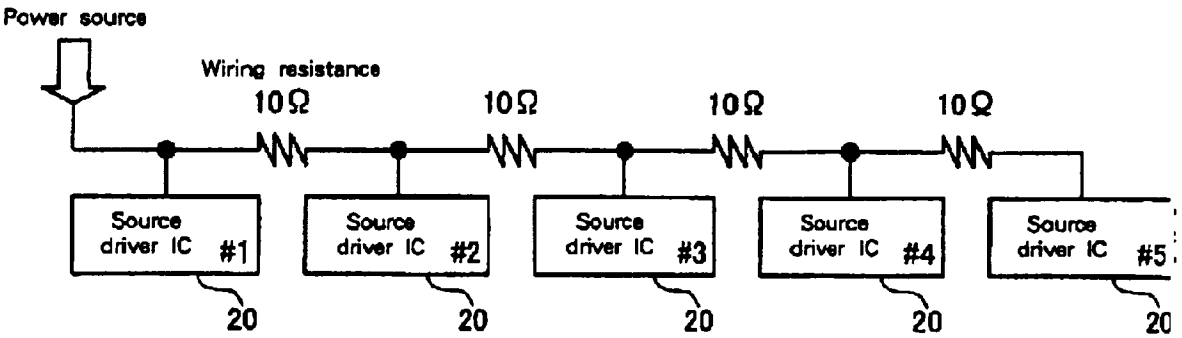
FIGS. 9(*a*) and (*b*) are diagrams for illustrating an example wiring model of a power supply line according to the present invention.

FIGS. 9(*a*) and (*b*) are diagrams for illustrating an example wiring model of a power supply line according to the present invention. There is shown a power supply wiring model for supplying power to five source driver ICs 20. In this model, it is assumed that source driver ICs 20 are mounted on the TFT array substrate and the power supply line is formed using aluminum wiring on the TFT array substrate. For this reason, relatively large wiring resistance of 10Ω is assumed between each of the source driver ICs 20. Each of the source driver ICs 20 is supplied power from the power source continuously in a single stroke of the brush fashion. FIG. 9(*b*) shows the contents of the setting registers 34 in each of the source driver ICs 20. Setting register 34 in chip #5, which is the source driver IC 20 located farthest away from the power source, is set to zero.

Figure 10:
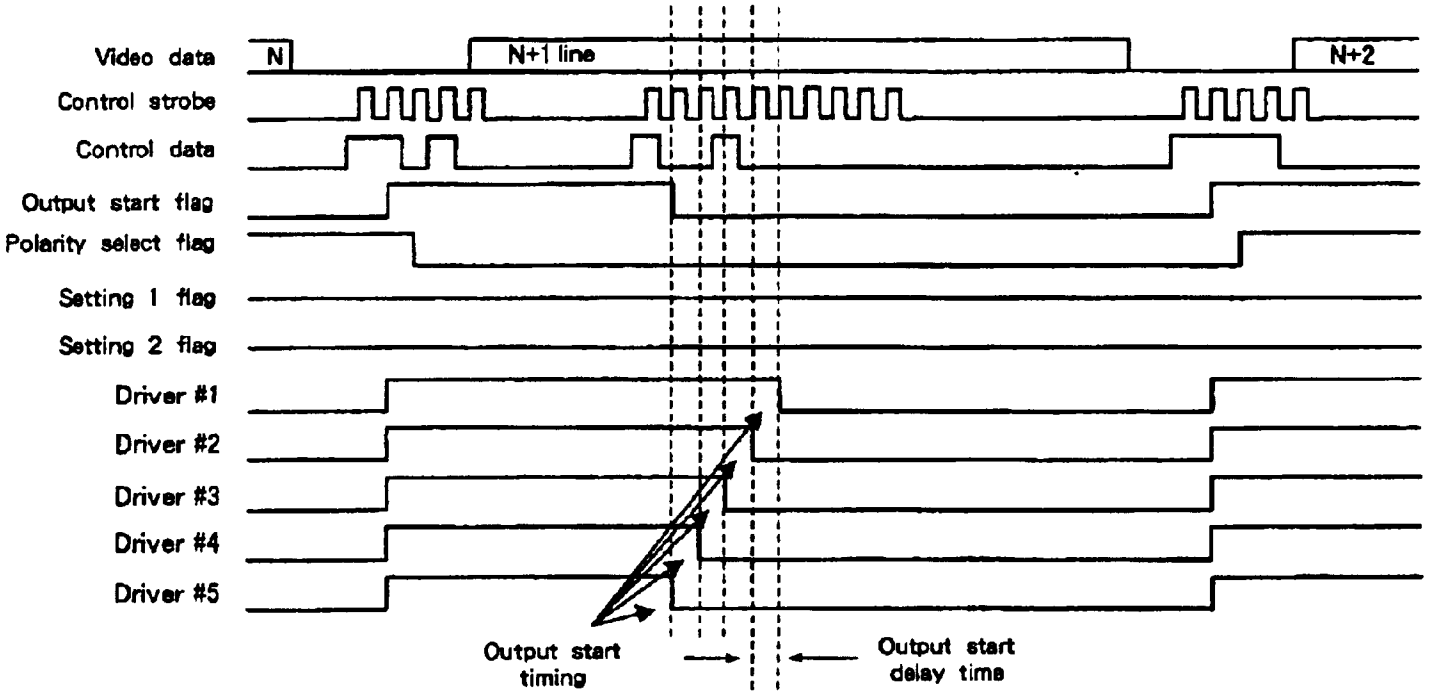
FIG. 10 depicts a timing chart for source driver IC generating delay time to start writing for the model shown in FIGS. 9(*a*) and (*b*).

FIG. 10 depicts a timing chart for source driver IC 20 generating delay time to start writing for the model shown in FIGS. 9(*a*) and (*b*). The driver #1 through driver #5 correspond to source driver ICs 20, #1 through #5, shown in FIGS. 9(*a*) and (*b*), respectively. Driver #1 is located upstream with respect to the power supply line, while driver #5 is located downstream. This timing chart shows that the N-th line of the LCD panel (i.e., liquid crystal cells 2) is being written, wherein the write start timing is delayed using the control strobe and control data signals as input signals. Furthermore, the write start timing is delayed for each of the source driver ICs 20, wherein writing is started sequentially from the downstream source driver IC 20 towards the upstream source driver IC 20.

The output start delay time is set to be one strobe period difference between each of the source driver ICs 20, as shown in FIG. 9(*b*). For example, assuming that the period of the control strobe signal is 800 nsec, the output start timing of each of the source driver ICs 20 is to be delayed by 800 nsec, respectively. This value is determined depending on the characteristics of the LCD panel to which the present invention is applied. For example, since the time constants of source lines of typical LCD panels are in a range of 200 nsec to 1000 nsec, it may be possible to temporally disperse the timing for peak current for each of the source driver ICs 20 by setting these values as their delay time. Moreover, the present invention should not limited to a typical method for starting to drive from downstream driver ICs towards upstream ones, but the driving sequence may be arbitrarily set, for example, from the upstream side towards the downstream side or from the center towards both sides, etc. However, it is preferable to first drive the one that is most affected by the voltage drop thus resulting in the lowest drive voltage (i.e., downstream driver IC farthest from the power source), and to finally drive the one that is least affected by the voltage drop thus resulting in the highest drive voltage (i.e., upstream driver IC closest to the power source), in order to match the completion time of writing among each of the source driver ICs 20.

In this way, according to an embodiment of the present invention, timer 33 is incorporated in each of the source driver ICs 20, wherein the write timing of the liquid crystal is set respectively. The timer 33 operates according to time information from LCD controller 4, wherein writing of the liquid crystal is started sequentially by the source driver IC 20 whose set time has passed by. Therefore, it becomes possible to cope with various kinds of LCD panels by changing the settings of timers 33 depending on the magnitude of the load of the LCD panels.

There has been described the system that operates according to time information output from LCD controller 4. On the other hand each of the source driver ICs 20 monitors the voltage drop on the power supply line and voluntarily controls the start timing for writing the liquid crystal such that the voltage drop does not exceed the predetermined value. This allows that source driver IC 20 with the smallest voltage drop (i.e., located most downstream with respect to the power supply line) first starts writing of the liquid crystal and that the time difference of the write start timing is automatically adjusted depending on the magnitude of the load of the LCD panels. In the embodiment 11, similar elements to the first embodiment are shown by the same reference numbers and a detailed description of them is omitted here.

Figure 11:
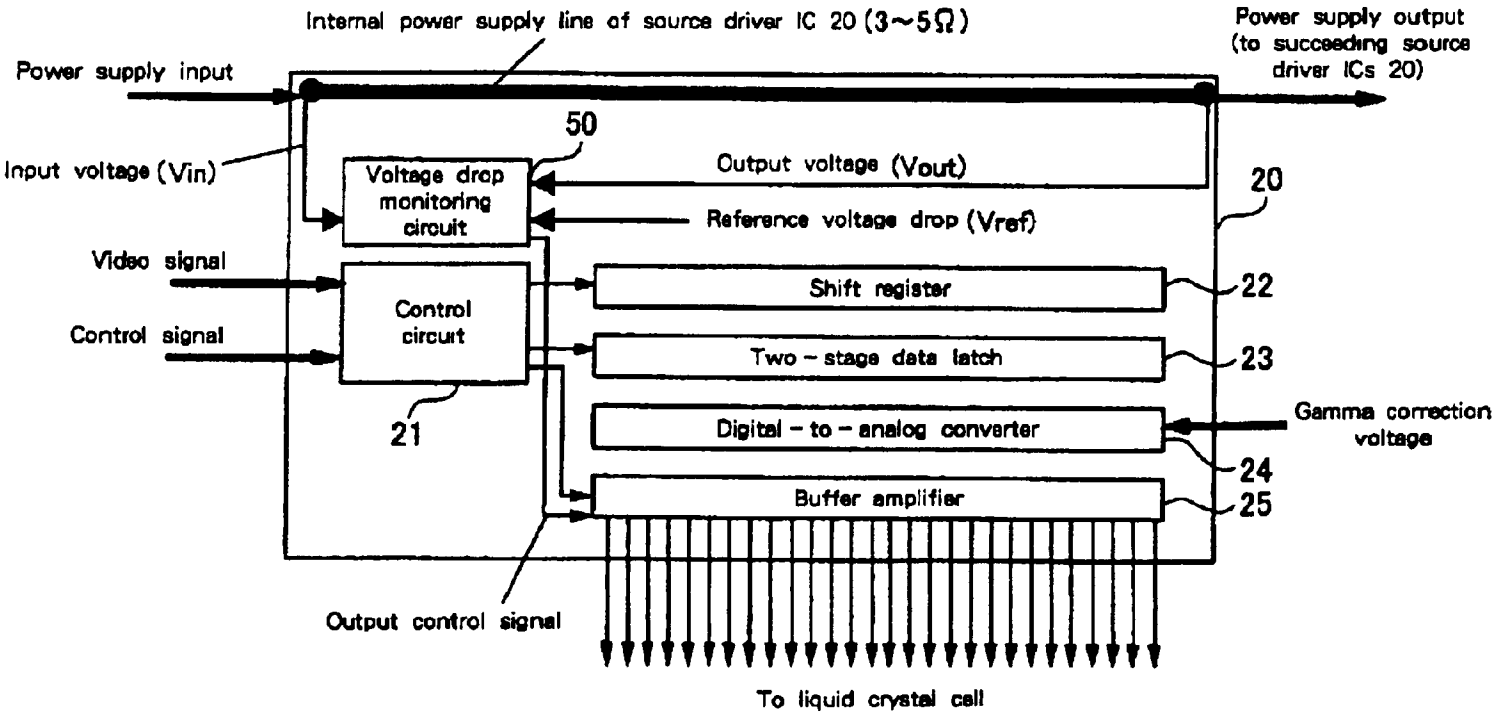
FIG. 11 depicts a configuration of a source driver IC according to the embodiment of the invention.

FIG. 11 depicts a configuration of source driver IC 20 according to another embodiment of the invention. It is characterized in that a voltage drop monitoring circuit 50 is incorporated in the source driver IC 20. Each of the source driver ICs 20 consists of an LSI with a chip length of 15 mm to 20 mm, wherein the internal wiring resistance of the power supply line in the chip is about 3Ω to 5Ω. In this embodiment, writing of the liquid crystal cells 2 is controlled by the voltage drop monitoring circuit 50 such that the voltage drop caused by the wiring resistance is kept below the reference value.

Figure 12:
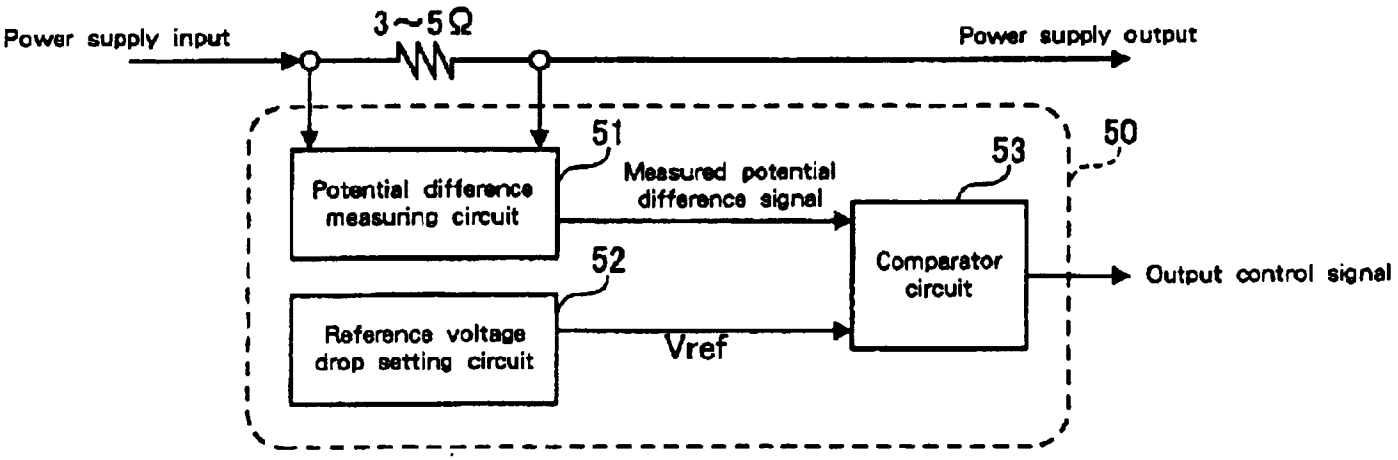
FIG. 12 depicts a configuration of a voltage drop monitoring circuit.

FIG. 12 depicts a configuration of voltage drop monitoring circuit 50. Voltage drop monitoring circuit 50 comprises a potential difference measuring circuit 51 for measuring a potential difference across the wiring resistance of the power supply line in the source driver IC 20; a reference voltage drop setting circuit 52 for setting the reference voltage drop; and a comparator circuit 53 for comparing the measured potential difference to the reference voltage drop (Vref) and outputting a control signal to turn on and off the buffer amplifier 25 located at the output stage of the source driver IC 20. The reference voltage drop setting circuit 52 may be located outside the source driver IC 20 to supply Vref to comparator circuit 53 instead of being incorporated in it.

Figure 13:
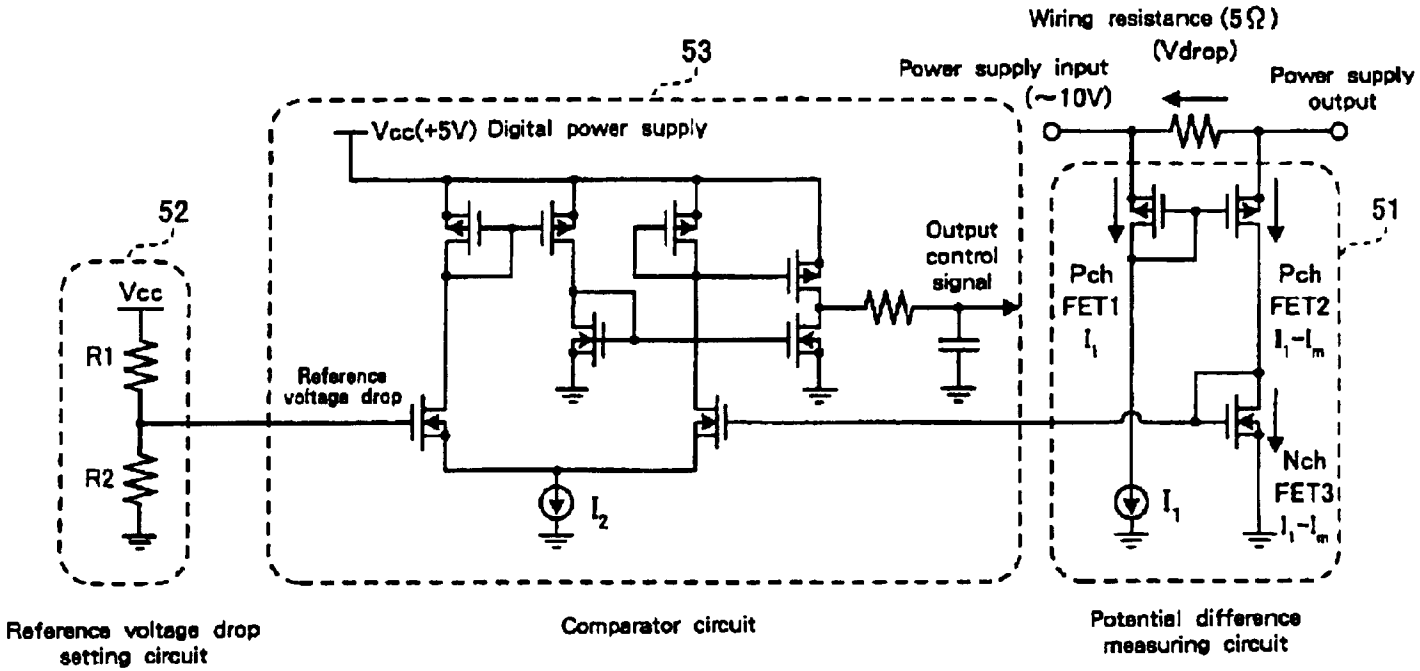
FIG. 13 depicts an example of the voltage drop monitoring circuit.

FIG. 13 depicts an example of voltage drop monitoring circuit 50. The potential difference measuring circuit 51 shown in FIG. 13 consists of a constant current source ($I_1$) comprised of transistors or the like and three FETs (FET1 to FET3). The constant current source ($I_1$) draws the current of about 10 $\mu$A or so from the power supply input through the FET1. When no drive current (i.e., several tens to several hundreds mA) is flowing through the wiring resistance, the current flowing FET1 is copied to FET2 and the copied current flows through FET3, where the current is converted to a voltage.

Figure 14:
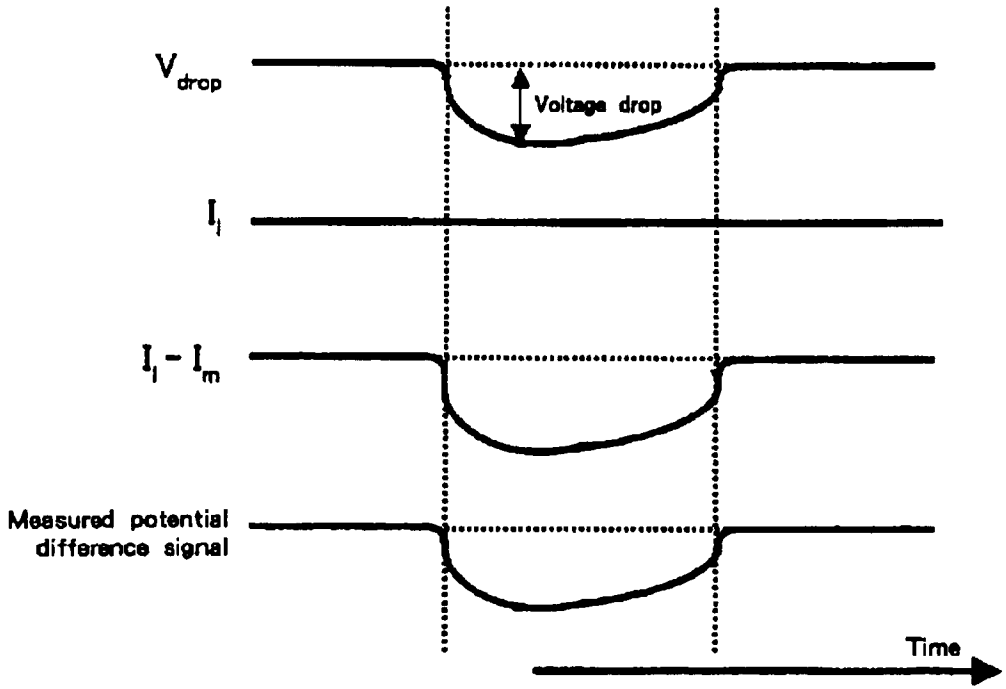
FIG. 14 depicts operation waveforms in a potential difference measuring circuit.

FIG. 14 depicts operation waveforms in the potential difference measuring circuit 51. When voltage drop ($V_{drop}$) occurs while the drive current flows, a voltage between the gate and source of FET2 decreases by $V_{drop}$, thus the current flowing the FET3 decreases to $I_1-I_m$. Consequently, the voltage generated at FET3 decreases depending on the drive current flowing through the wiring resistance, so that this voltage is used as the measured potential difference signal, which is input to comparator circuit 53.

It will now be described about reference voltage drop setting circuit 52. This circuit creates a reference voltage level of the measured potential difference signal. In the circuit shown in FIG. 13, this reference voltage level is created by dividing the power supply voltage Vcc using resistors R1 and R2. R1 is on the order of several tens K Ω, while R2 is adjusted in a range of several K Ω to ten-odd K Ω in order to adjust the reference voltage level. Reference voltage drop setting circuit 52 may be implemented as an external circuit, which supplies the reference voltage drop directly to each of the source driver ICs 20.

Figure 15:
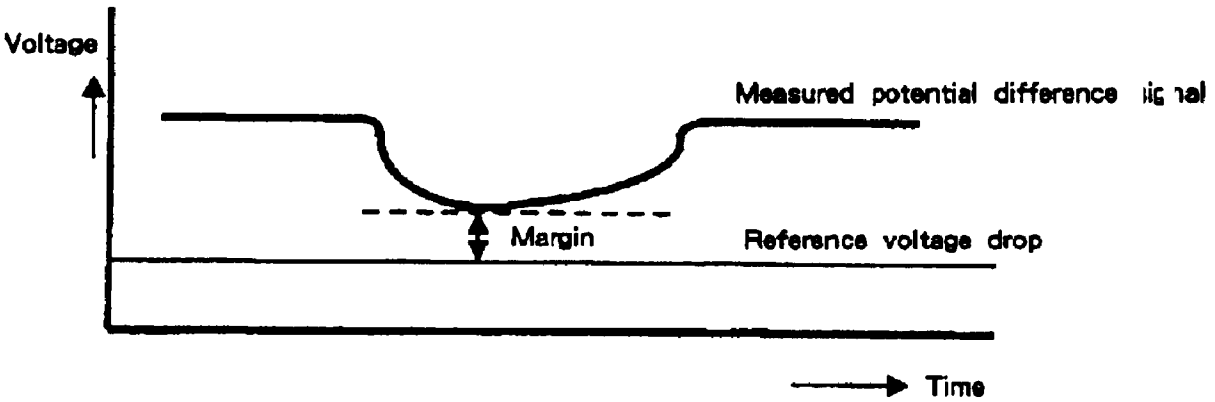
FIG. 15 depicts how the reference voltage drop is set.

FIG. 15 depicts how the reference voltage drop is set. This shows when the source driver IC 20 is operated independently. When the source driver IC 20 set like this starts writing of the liquid crystal, the measured potential difference signal would decrease. This results from the voltage drop that occurs due to the drive current with which the source driver IC 20 drives the liquid crystal. By setting the reference voltage drop close to a minimum value of the measured potential difference signal, the drive current for the source driver IC 20 itself is assured. If an acceptable current of the aluminum wiring on the glass is smaller than the drive current of the source driver IC 20 itself, the reference voltage drop should be set to be higher than the minimum value of the measured potential difference signal. On the contrary, the acceptable current of the aluminum wiring on the glass is large enough, the margin shown in FIG. 15 may be set to be large enough.

Now it will be described about comparator circuit 53. Comparator circuit 53 compares the measured potential difference signal from the potential difference measuring circuit 51 and the reference voltage drop from the reference voltage drop setting circuit 52 and outputs a low level output control signal when the measured potential difference signal falls below the reference voltage drop. The buffer amplifier 25 shown in FIG. 11 stops writing of the liquid crystal while comparator circuit 53 outputs the low level output control signal.

Figure 16:
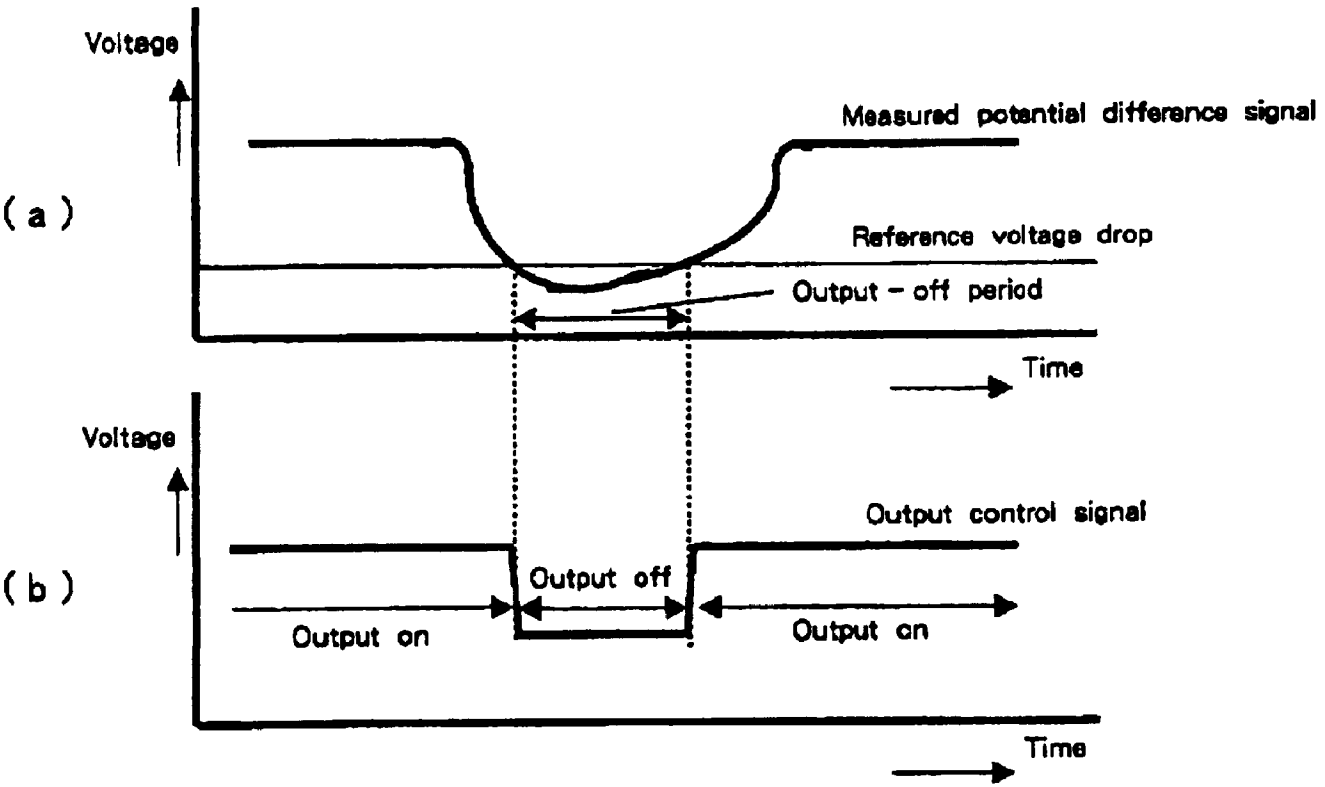
FIGS. 16 (*a*) and (*b*) depicts operation waveforms in a comparator circuit.

FIGS. 16(*a*) and (*b*) depicts operation waveforms in comparator circuit 53. This shows when multiple source driver ICs 20 are operated. When the source driver IC 20 located downstream with respect to the power supply line starts writing of the liquid crystal, a voltage drop greater than the reference voltage drop occurs for the source driver ICs 20 located upstream of that source driver IC 20, as shown in FIG. 16(*a*). These source driver ICs 20 located upstream turn off their outputs to stop their own writing in order to lower the voltage drop while the measured potential difference signal falls below the reference voltage drop, as shown in FIG. 16(*b*). In this way, when power is supplied to source driver ICs 20 in a single stroke of the brush fashion (i.e., continuously) from the upstream side towards the downstream side by means of bus connections or cascade connections, and the driver ICs incorporate voltage drop monitoring circuit 50 according to the invention, writing of the liquid crystal can be performed sequentially starting from the source driver IC 20 located most downstream with respect to the power supply line.

Figure 17:
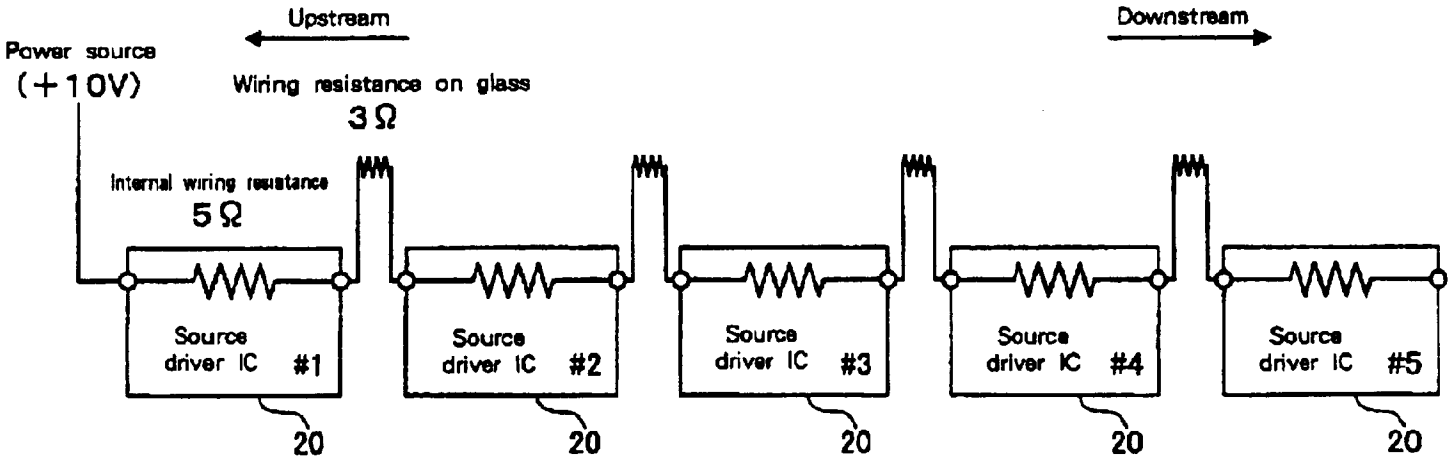
FIG. 17 depicts an example wiring model of a power supply line according to the embodiment 11 of the present invention.

FIG. 17 depicts an example wiring model of a power supply line according to the embodiment 11 of the present invention. In this model, multiple source driver ICs 20 are connected in a single stroke of the brush fashion (i.e., continuously) by means of cascade connections, wherein power is supplied from the upstream side close to the power source towards the downstream side far from it. In this example, it is assumed that the wiring resistance on the glass is about 3Ω and the internal resistance of each of the source driver ICs 20 is about 5Ω. When power is supplied simultaneously to all of the source driver ICs 20, the voltage drop at the upstream source driver ICs 20 becomes large because larger current flows through the power supply wiring line, while the voltage drop at the downstream source driver ICs 20 is small because smaller current flows through the power supply wiring line. Therefore, writing would be performed sequentially starting from the downstream source driver IC 20 by setting the same reference voltage drop.

Figure 18:
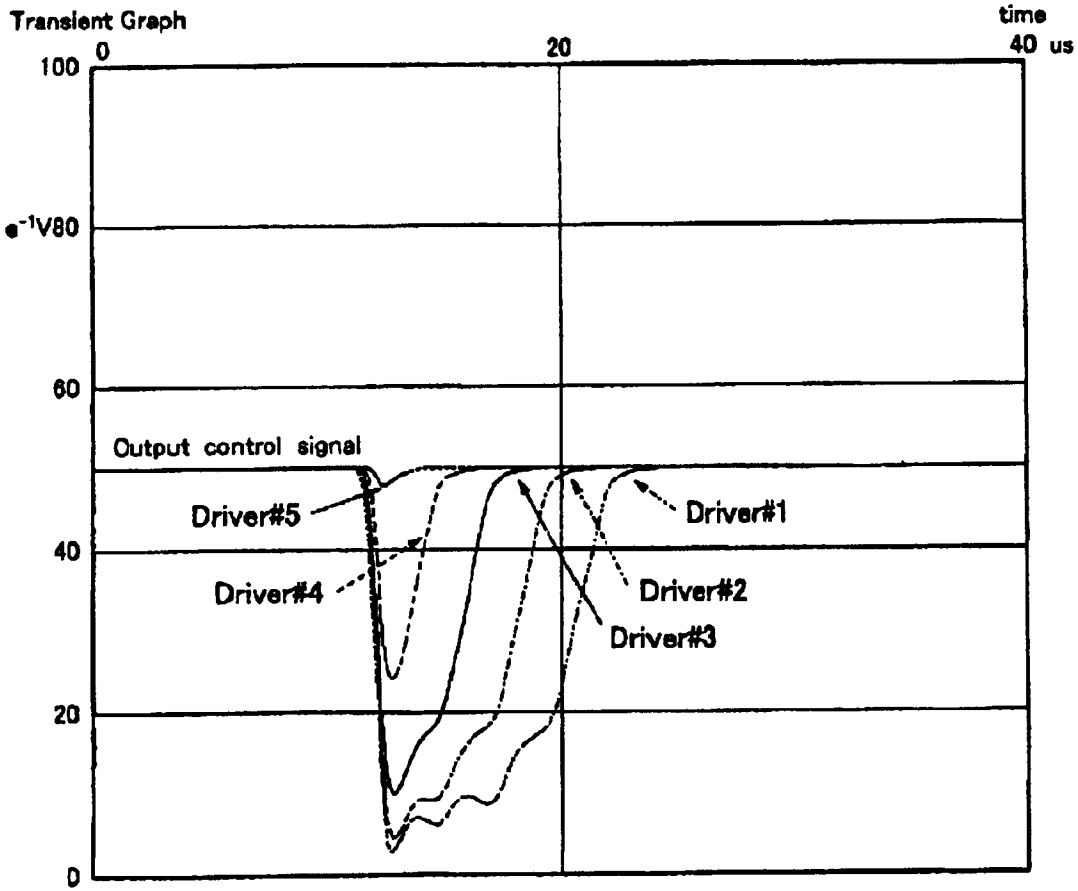
FIG. 18 depicts output control signals output to a buffer amplifier from a comparator circuit in each of source driver ICs.

FIG. 18 depicts output control signals output to buffer amplifier 25 from comparator circuit 53 in each of the source driver ICs 20. In this case, the source line load of the TFT array is 50 pF and 10 k Ω. For driver #5 which is the source driver IC 20 located most downstream, the voltage drop caused only by its own load is output as the output control signal. For driver #4 which is the source driver IC 20 located upstream of driver #5, the voltage drop caused by the load of driver #5 in addition to its own load is output as the output control signal, which becomes low (0) and thus stops writing of the liquid crystal. The output control signal becomes high (1) again after the writing voltage to write the liquid crystal has been supplied to driver #5, and then writing of the liquid crystal is started. For the driver #1 which is the source driver IC 20 located most upstream, the output control signal remains low (0) until the writing voltage is supplied to driver #2 and after that it goes to high (1) again. It should be noted that the start timing for writing the liquid crystal is automatically adjusted even when the source line load is changed.

As described above, according to the second embodiment, each of the source driver ICs 20 monitors the voltage drop on the power supply line and voluntarily controls the start timing for writing the liquid crystal such that the voltage drop does not exceed the predetermined value. Namely, a circuit is incorporated for monitoring the voltage drop on the power supply line and comparing it to the predetermined reference voltage drop and stopping writing of the liquid crystal when the voltage drop exceeds the predetermined reference voltage drop. This allows the source driver ICs 20 to write the liquid crystal automatically in ascending order of voltage drop (i.e., source driver IC 20 located most downstream with respect to the power supply line first performs writing).

Now the advantages of the present invention will be described.

Figure 19:
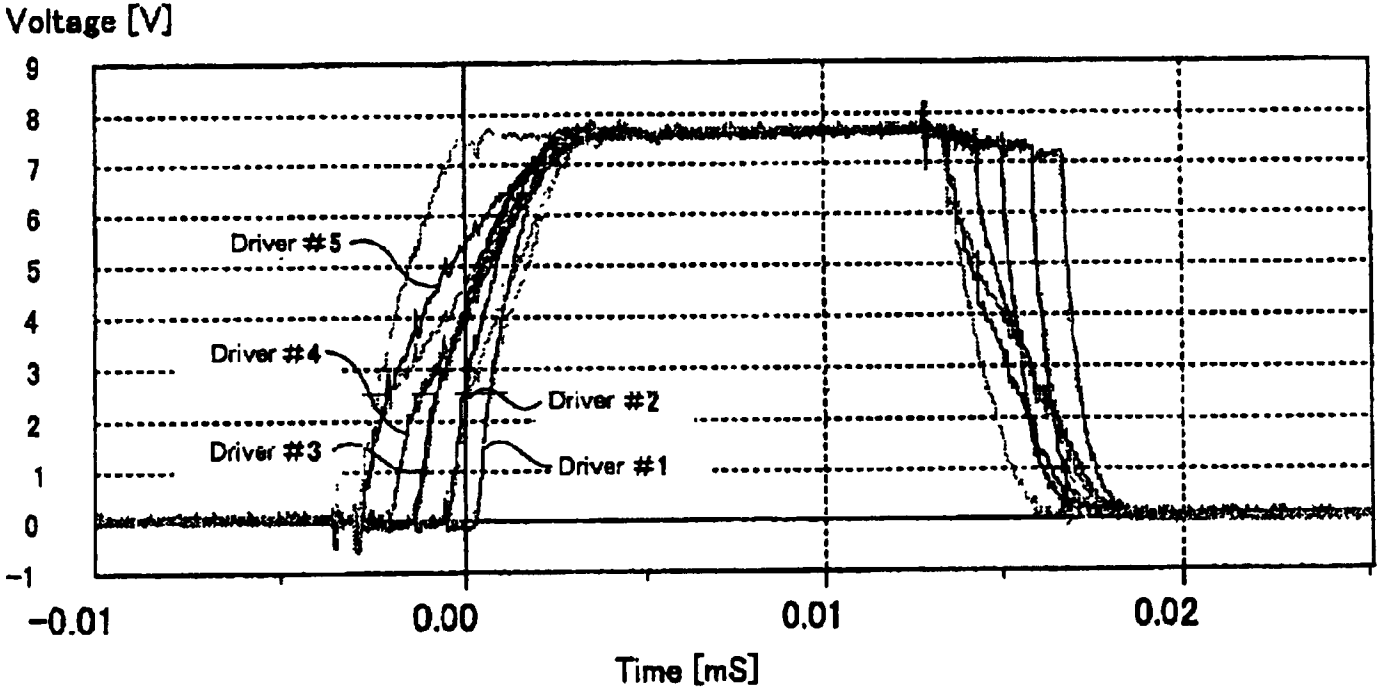
FIG. 19 depicts measured results of the output voltage from each of source driver Ics.

FIG. 19 depicts measured results of the output voltage from each of the source driver ICs 20, wherein the output start delay time is set to be 800 nsec for each of the source driver ICs 20. It is clear from FIG. 19 that five source driver ICs 20 performs writing with delaying the timing respectively and that the output voltage rises to a constant voltage respectively. The output waveform of the most downstream source driver IC 20 (i.e., driver #5) rises first, however, it takes much time to perform writing due to a large voltage drop of the power supply. On the contrary, the most upstream source driver IC 20 (i.e., driver #1) rises at the last, however, it completes writing quickly because it is affected only by a small voltage drop. It should be noted that an image quality is never adversely affected by the driving scheme of the invention because necessary write time is maintained for a pixel capacity in each of the source driver ICs 20.

Figure 20:
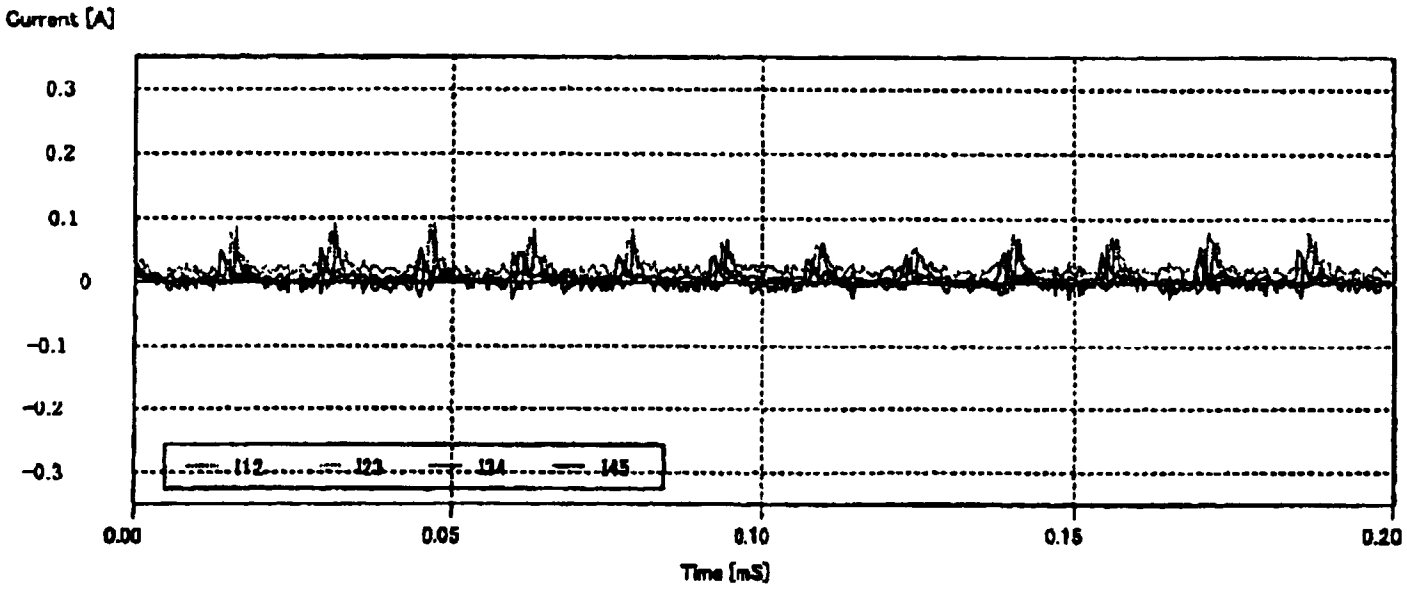
FIG. 20 depicts measured current results on the power supply line when controlling the write timing according to the present invention.
Figure 21:
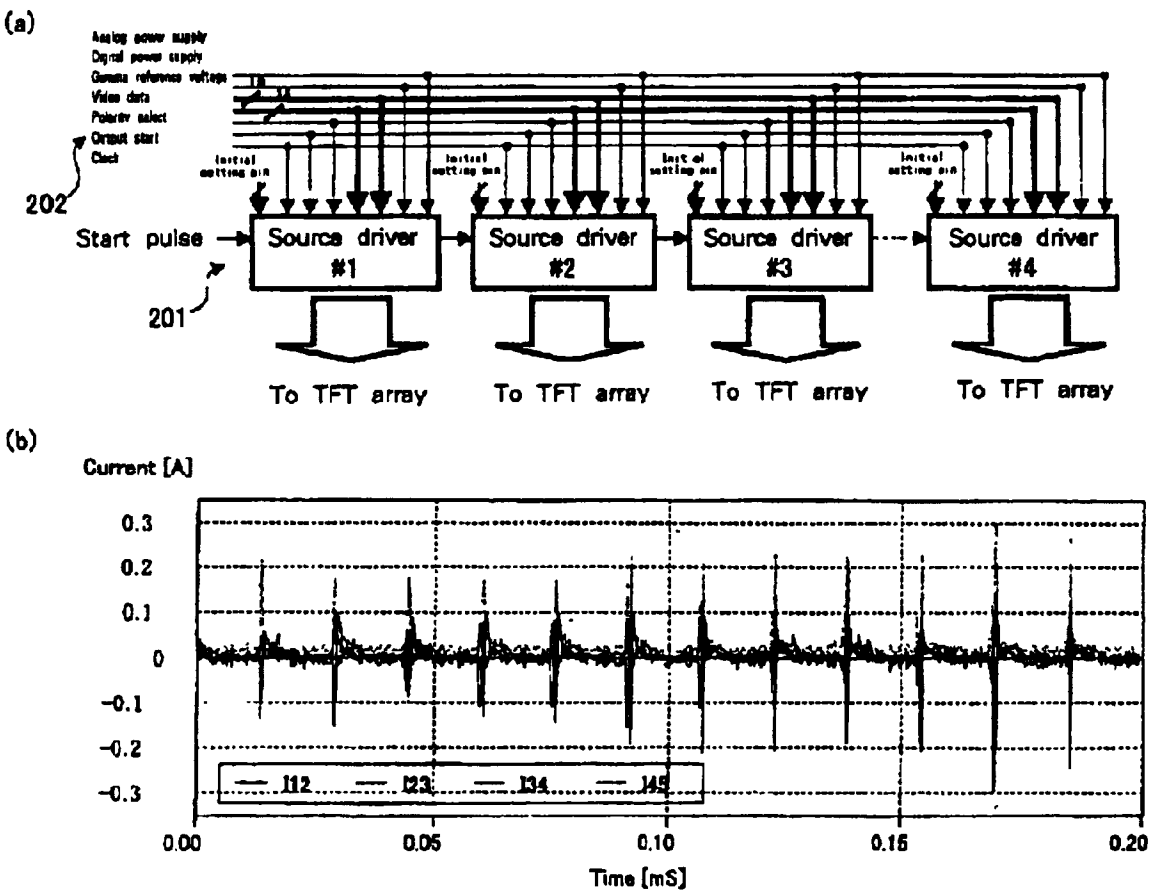
FIGS. 21 (*a*) and (*b*) shows an example of wiring for a source driver and measured current results on the power supply line when writing the liquid crystal simultaneously.

FIG. 20 depicts measured current results on the power supply line when controlling the write timing according to the present invention. Compared with the measured current results according to the conventional simultaneous writing shown in FIG. 21(*b*), it is evident that the spike current is reduced in the embodiments I and II of the present invention and that the peak current is reduced to one-third or one-fourth at best of the conventional writing scheme.

In summary, according to the embodiments of the invention, power supply for source driver ICs 20 mounted on the TFT array substrate is supplied in a single stroke of the brush fashion (i.e., continuously) by means of bus connections or cascade connections. For this configuration, writing of the liquid crystal is sequentially performed with a predetermined time difference starting from a source driver IC 20 located most downstream with respect to the power supply line towards the one located most upstream. Namely, according to the features of the invention, it is possible to freely set the start timing for writing the liquid crystal, thus capable of coping with various kinds of LCD panels. This allows to avoid the concentration of write current of the source driver ICs 20 on the power supply line upon start of writing and thus to reduce the voltage drop on the glass substrate. Moreover, since large spike current is greatly reduced, the life time of the power supply line could be extended, where failures could possibly be reduced that would occur on the aluminum wiring on the glass substrate.

As mentioned above, according to the present invention, it becomes possible to reduce the concentration of current consumption for the source driver.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

1. A liquid crystal display, comprising:

a power source;

liquid crystal cells for forming an image display area on a substrate;

a driver for applying a voltage to said liquid crystal cells using a plurality of driver ICs, wherein said plurality of driver ICs sequentially drive said liquid crystal cells starting from a first liquid crystal cell located farthest away from said power source towards a second liquid crystal cell located closer to said power source; and an LCD controller for processing signals received from a host's side and supplying the processed signals to said driver ICs, wherein said driver delays the start timing for writing said liquid crystal cells among the plurality of driver ICs respectively to avoid concentration of current consumption.

2. The liquid crystal display according to claim 1, wherein said driver is characterized in that the plurality of driver ICs are mounted on said substrate and power is supplied to the plurality of driver ICs via a physically continuous wiring line.

3. The liquid-crystal display according to claim 1, wherein paid LCD controller outputs timing setting data that indicates delay time for the plurality of driver ICs to start writing of said liquid crystal cells.

4. The liquid crystal display according to claim 1, wherein said LCD controller outputs serialized control data signal that includes an output start signal indicative of start timing of outputting to the liquid crystal cells and a polarity select signal indicative of polarity of the liquid crystal output.

5. A liquid crystal display, comprising:

liquid crystal cells for forming an image display area on a substrate; and a plurality of driver ICs which are supplied power by means of bus connections or cascade connections on the substrate and each including a timer that operates according to time information from an LCD controller, wherein said plurality of driver ICs sequentially drive said liquid crystal cells starting from a downstream liquid crystal cell located farthest away from a power source, wherein each of the plurality of driver ICs is set start timing for writing said liquid crystal cells respectively and measures the write start timing by using said timer, and wherein the driver IC that meets the conditions starts writing of said liquid crystal cells sequentially.

6. The liquid crystal display according to claim 5, wherein said write start timing respectively set is determined depending on a wiring capacity of a power supply line for each of the driver ICs.

7. A liquid crystal display driver for performing writing of liquid crystal cells that form an image display area by sequentially applying a voltage thereto, the driver comprising:

a setting register for storing information about write delay time for delaying write timing of said liquid crystal cells;

a counter for counting said write delay time stored in said setting register;

a sequencer for activating a delayed output start signal based on an output from said counter; and a control circuit for controlling the writing of said liquid crystal cells based on said output start signal activated by said sequencer, wherein said output start signal starts at a downstream liquid crystal cell located farthest away from a power source towards upstream liquid crystal cells located closer to said power source.

8. The liquid crystal display driver according to claim 7, wherein said setting register reads timing setting data output from an LCD controller and stores information about said write delay time.

9. The liquid crystal display driver according to claim 7, wherein said setting register reads a control data signal output from an LCD controller based on timing of a control strobe signal output from the LCD controller.

10. An LCD controller for processing signals received from a host's side and supplying the processed signals to a plurality of driver ICs in a timed manner, the LCD controller comprising:

means for outputting timing setting data that represents delay time for said driver ICs to start outputting to liquid crystal cells starting from the downstream driver IC located farthest away from a power source; and means for outputting a control strobe signal to count said delay time stored in said driver ICs according to said timing setting data.

11. The LCD controller according to claim 10, wherein said timing setting data output means outputs said timing setting data during a period when video data is not being transferred.

12. The LCD controller according to claim 10, further comprising means for serial transferring to said driver ICs as control data signals an output start signal for starting a liquid crystal output and a polarity selects signal indicating a polarity of the liquid crystal output.

13. A method for driving a plurality of driver ICs that are provided on a substrate on which liquid crystal cells are formed, wherein the driver ICs apply a writing voltage to the liquid crystal cells starting from the downstream driver IC located farthest away from a power source, and are supplied power in a single stroke of the brush fashion, the method comprising the steps of:

setting write start timing for applying the writing voltage to said liquid crystal cells for each of said plurality of driver ICs;

counting according to predetermined time information; and applying the writing voltage to said liquid crystal cells sequentially from the driver IC that has reached said write start timing.

14. The method according to claim 13, further including the step of setting said write start timing based on timing setting data, which is sent from an LCD controller controlling said plurality of driver ICs just in the same procedure as video data.

* * * * *